US007958910B2

(12) United States Patent
Nakamori et al.

(10) Patent No.: US 7,958,910 B2
(45) Date of Patent: Jun. 14, 2011

(54) FILLING NOZZLE

(75) Inventors: Keita Nakamori, Yokohama (JP); Yoshiyuki Morita, Yokohama (JP)

(73) Assignee: Toyo Seikan Kaisha, Ltd., Chiyoda-Ku (JP)

( * ) Notice: Subject to any disclaimer, the term of this patent is extended or adjusted under 35 U.S.C. 154(b) by 0 days.

(21) Appl. No.: 12/447,056

(22) PCT Filed: Oct. 24, 2007

(86) PCT No.: PCT/JP2007/070742

§ 371 (c)(1),
(2), (4) Date: Jul. 20, 2009

(87) PCT Pub. No.: WO2008/053763

PCT Pub. Date: May 8, 2008

(65) Prior Publication Data

US 2010/0024910 A1 Feb. 4, 2010

(30) Foreign Application Priority Data

Oct. 27, 2006 (JP) ..... 2006-292501

(51) Int. Cl.
*F15D 1/04* (2006.01)

(52) U.S. Cl. ..... 138/44; 138/37; 138/39

(58) Field of Classification Search ..... 138/41, 138/44, 37, 39

See application file for complete search history.

(56) References Cited

U.S. PATENT DOCUMENTS

| | | | | | |
|---|---|---|---|---|---|
| 2,484,972 | A * | 10/1949 | Turrettini | ..... | 353/101 |
| 3,519,024 | A * | 7/1970 | Herzog et al. | ..... | 138/41 |
| 3,572,391 | A * | 3/1971 | Hirsch | ..... | 138/40 |
| 4,248,270 | A * | 2/1981 | Ostrowski | ..... | 138/45 |
| 5,529,093 | A * | 6/1996 | Gallagher et al. | ..... | 138/44 |
| 6,193,011 | B1 * | 2/2001 | Harris | ..... | 181/214 |

FOREIGN PATENT DOCUMENTS

| | | | |
|---|---|---|---|
| EP | 1 736 411 | A1 | 12/2006 |
| JP | 07-041951 | B2 | 5/1995 |
| JP | 2551969 | Y2 | 10/1997 |
| JP | 2003-205911 | A1 | 7/2003 |
| JP | 2004-182245 | A1 | 7/2004 |
| JP | 3677776 | B2 | 8/2005 |
| JP | 2005-324862 | A1 | 11/2005 |
| JP | 2006-224973 | A1 | 8/2006 |

* cited by examiner

*Primary Examiner* — Patrick F Brinson
(74) *Attorney, Agent, or Firm* — Burr & Brown

(57) ABSTRACT

A filling nozzle is provided which has a high flow straightening effect and is capable of forming a stable liquid flow of a circular cross section. In a filling nozzle in which a flow straightening member for straightening the flow of liquid is arranged in a hollow nozzle body, a flow straightening plate with a multitude of fine holes formed therethrough so as to pass the liquid therethrough is used a the flow straightening member, and a divergent chamfered portion, which act as a guide means for guiding fine streams of liquid flowing out from adjacent individual fine holes in a direction to bring them into contact with one another, is formed on an opening edge of an outlet of each fine hole on an outlet side surface of the flow straightening plate.

5 Claims, 4 Drawing Sheets

(A)

(A)

(B)

(C)

FILLING NOZZLE

FIELD OF THE INVENTION

Figure 1:
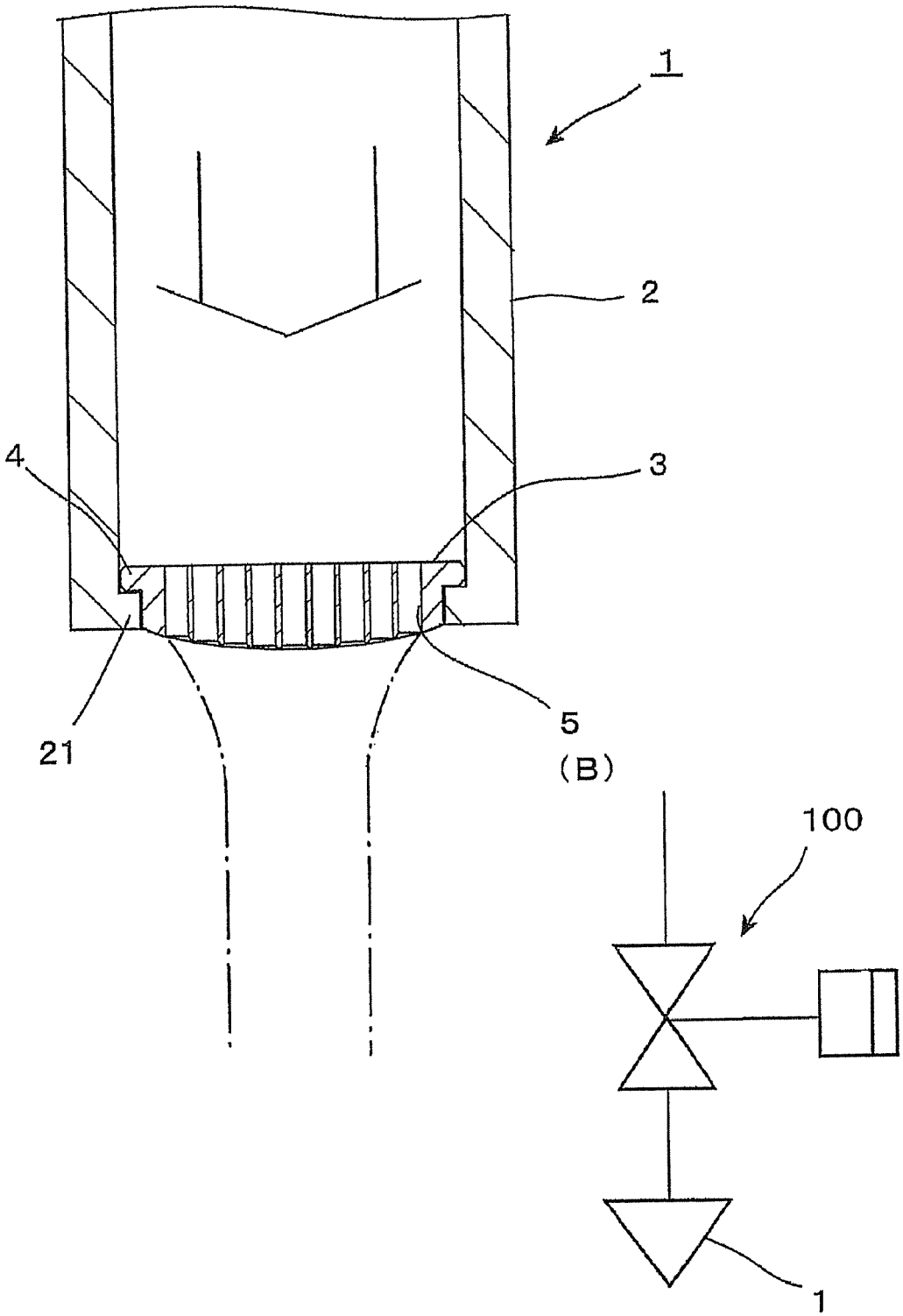

The present invention relates to a filling nozzle used for a filler valve of a liquid filling apparatus that fills drinking liquid to a container for example.

BACKGROUND OF THE INVENTION

Conventional filling nozzles are used as a filler valve for a contactless liquid filling apparatus, such kinds have been known as those described in a first and a second patent document. Filling nozzles described in these documents are constructed as follows. That is, a flow straightening plate with a multitude of fine holes formed therethrough with one or more meshes that are built into a hollow nozzle body as flow straightening members for straightening the flow of liquid injected through the nozzle body, so that an effect of straightening the flow of filling contents can be obtained by means of a buffering or damping action thereof, and at the same time, the liquid is retained by the reticulations of the meshes due to the surface tension thereof particularly when the filling of liquid is stopped, thereby preventing the liquid from dripping.

However, in case where the content of the liquid to be filled or injected contains highly viscous and fibrous materials, the viscous and fibrous materials clog the meshes and are unsuitable for filling or injection. If the mesh sizes of the meshes are made larger, the clogging thereof can be prevented, but it becomes impossible to prevent liquid dripping at the time when the filling or injection is stopped.

Accordingly, it is considered to deal with liquid dripping by adjusting the size of fine holes in the flow straightening plate to such an extent as to allow the viscous materials and the fibrous materials to pass therethrough and at the same time making the length of each fine hole longer to a certain extent. However, with the conventional flow straightening plate, there arises a problem that the liquid flowing out from outlets of the fine holes becomes independent and liquid streams flow out therefrom in a shower-like manner, with the ambient air entrained therein, the result is that a stable liquid flow can not be obtained. If the density of the fine holes is increased, the individual streams of liquid from the fine holes will be able to be converged, but there is also a limitation in increasing the density of the fine holes.

First Patent Document

Japanese patent application laid-open No. 2003-205911

Second Patent Document

Japanese patent application laid-open No. 2004-182245

SUMMARY OF THE INVENTION

Problems to be Solved by the Invention

The present invention has been made to solve the problems of the prior art as referred to above, and has for its main object to provide a filling nozzle in which a flow passage that is less prone to be clogged, ensuring a stable liquid flow can be formed, with no liquid drip from a tip end thereof when the liquid flow is stopped.

Means for Solving the Problems

In order to achieve the above-mentioned object, the invention preferably includes a filling nozzle in which a flow straightening member for straightening the flow of liquid injected through the interior of a nozzle body is arranged in the hollow nozzle body, the flow straightening member is composed of a flow straightening plate with a plurality of fine holes formed therethrough so as to pass the liquid, and a guide means being formed on a surface of the flow straightening plate at an outlet side thereof for guiding fine streams of liquid flowing out from the adjacent individual fine holes in a direction that brings them into contact with one another.

The invention preferably includes that the shape of the surface of the flow straightening plate at the outlet side thereof, so that a central portion thereof protrudes toward a downstream side more than a peripheral portion thereof does.

The invention preferably includes that the guide means provides a divergent chamfered portion formed at an outlet of each fine hole.

The invention preferably includes that the guide means provides circumferential grooves connecting outlets of the individual fine holes to one another.

The invention preferably includes that the guide means provides radial grooves connecting the outlets of the individual fine holes to one another.

Effects of the Invention

According to the first aspect of the present invention, the flow straightening plate having the plurality of fine holes as the flow straightening member, liquid dripping can be prevented by increasing the length of each fine hole even if the size of each fine hole is set to such a size as to allow the passage of fibrous materials.

In addition, because the guide means is formed on the surface of the flow straightening plate at the outlet side thereof, the streams of liquid independently injected from the individual adjacent fine holes can be brought into contact with one another on the outlet surface of the flow straightening plate in a reliable manner, whereby the liquid regulated through the fine holes can be caused to flow out in a stable manner without entraining air therein.

According to the second aspect of the present invention, the surface shape of the flow straightening plate is such that the central portion thereof protrudes toward a downstream side more than the peripheral portion thereof does. With such construction, the streams of liquid, being brought into contact with one another on the outlet side surface of the flow straightening plate, can be converged in the central portion of the plate to form a stable liquid flow.

According to the third aspect of the present invention, it is constructed such that a chamfered portion is formed at the outlet of each fine hole as the guide means and the flow of liquid can be regulated with an extremely simple construction.

According to the fourth or fifth aspects of the present invention, the filling nozzle can be produced in an easy manner by using the circumferential grooves or radial grooves as the guide means.

BRIEF DESCRIPTION OF THE DRAWINGS (A) of FIG. 1 is a schematic cross sectional view of a filling nozzle according to a first embodiment of the present invention, and (B) of FIG. 1 is a schematic view showing the conduit construction of a filling apparatus to which the filling nozzle is applied.

Figure 2:
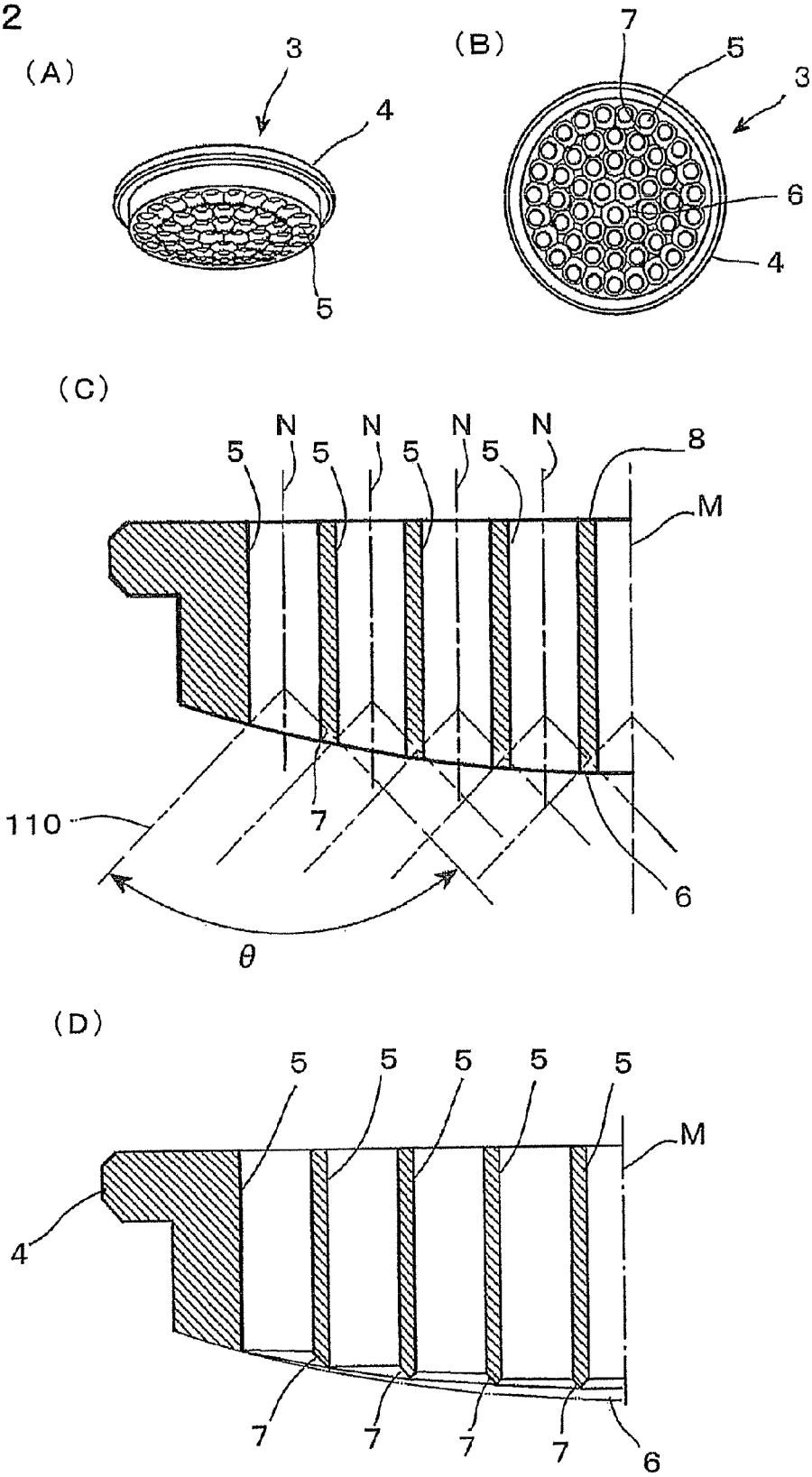

FIG. 2 shows a flow straightening plate of the filling nozzle of FIG. 1, wherein (A) of this figure is a perspective view thereof; (B) of this figure is a bottom view thereof; (C) of this figure is an enlarged half vertical cross sectional view showing the state of outlets of fine holes on an outlet side surface before chamfering; and (D) of this figure is a half vertical cross sectional view similar to (C) of this figure after chamfering.

Figure 3:
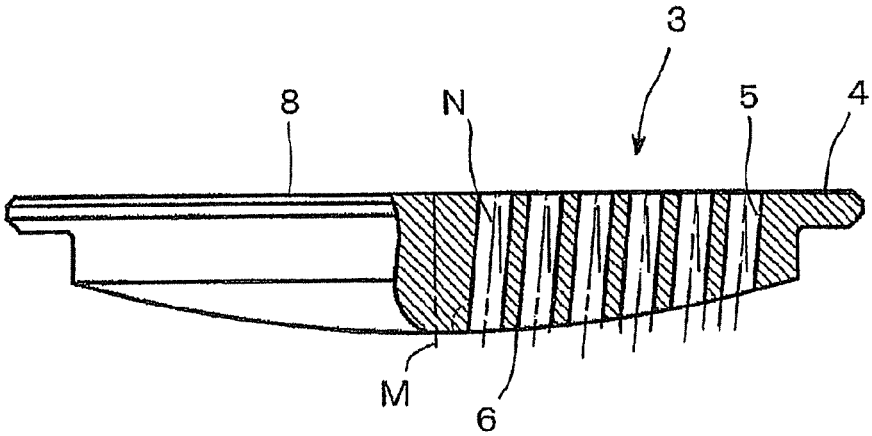
Figure 3:
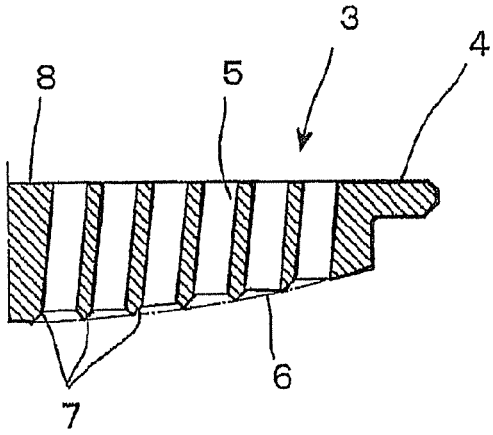
Figure 3:
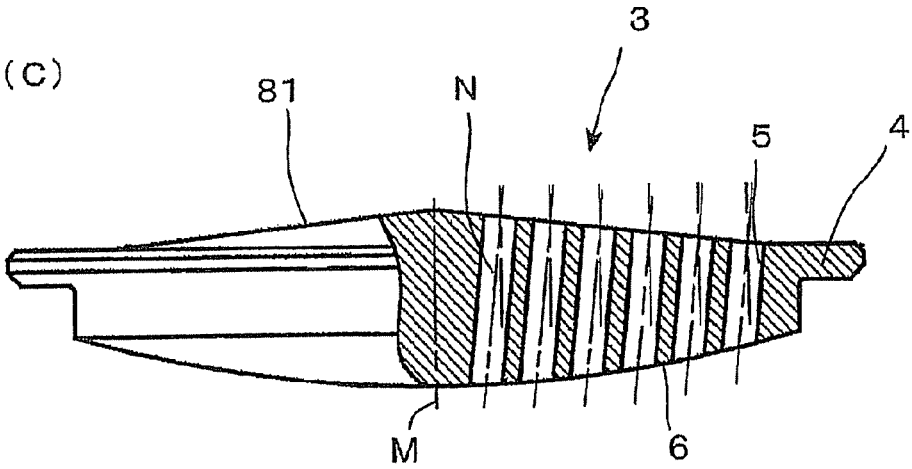

FIG. 3 shows a modification of the flow straightening plate of the first embodiment of the present invention, wherein (A) of this figure is a front elevational view showing a part thereof in cross section before chamfering; (B) of this figure is a half vertical cross sectional view similar to (A) of this figure after chamfering; and (C) of this figure is a partially broken front elevational view showing a modification of the shape of an inlet side end face of (A) of this figure.

Figure 4:
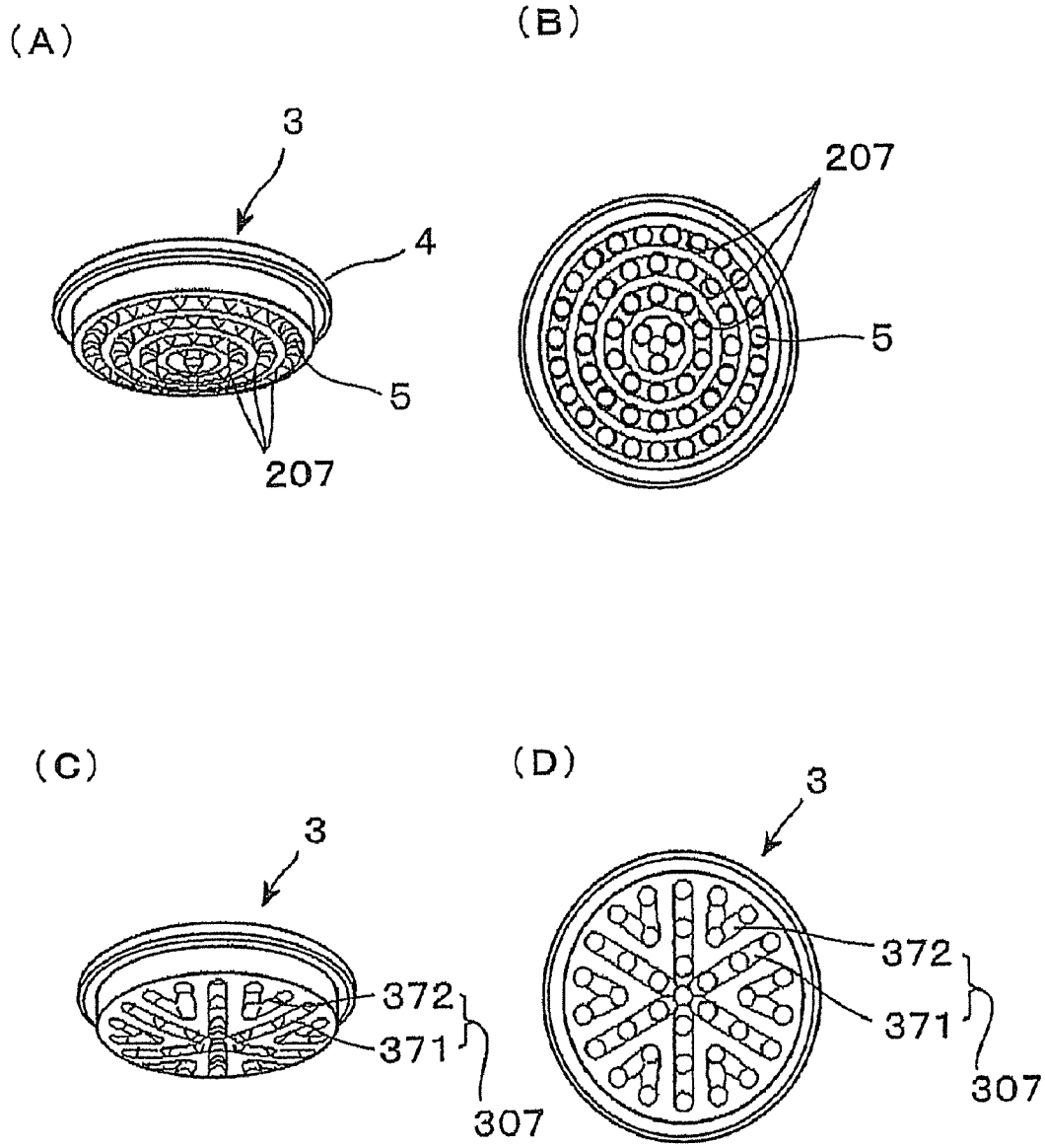

(A) and (B) of FIG. 4 show a filling nozzle according to a second embodiment of the present invention, wherein (A) is a perspective view thereof; and (B) is a bottom view thereof. (C) and (D) of FIG. 4 show a filling nozzle according to a third embodiment of the present invention, wherein (C) is a perspective view thereof; and (D) is a bottom view thereof.

EXPLANATION OF SYMBOLS

1 a filling nozzle
2 a nozzle body
3 a flow straightening plate
21 an annular convex portion
4 an engagement flange
5 fine holes
6 an outlet side surface
7 chamfered portions (guide means)
8, 81 inlet side end faces
100 a filler valve
207 circumferential grooves (guide means)
307 radial grooves (guide means)
371 radius grooves
372 V-shaped grooves

DETAILED DESCRIPTION OF THE INVENTION

Hereinafter, the present invention will be described based on embodiments illustrated in the accompanying drawings.

Embodiment 1

FIG. 1 shows a filling nozzle according to a first embodiment of the present invention.

The filling nozzle 1 is used for a filler valve of an unillustrated contactless type liquid filling apparatus, and is arranged at a downstream side of a filler valve 100, as shown in FIG. 1(B).

The structure of the filling nozzle 1 is such that a flow straightening plate 3, which constitutes a flow straightening member for straightening a flow of liquid, is arranged in the interior of a hollow nozzle body 2, which constitutes a conduit for the liquid to be filled.

The flow straightening plate 3 is in the form of a thick disk-shaped member having a multitude of fine holes 5 for passing the liquid therethrough, and is arranged in such a manner so as to close or cover an opening portion of the nozzle body 2 at its tip end. The nozzle body 2 has an inwardly directed annular convex portion 21 formed in the tip end opening portion thereof, and the flow straightening plate 3 has an engagement flange 4 formed on an outer periphery thereof to engage this annular convex portion 21. The engagement flange 4 is arranged at an upstream end portion in the flow direction of the liquid, and is adapted to be engaged with an inner periphery of the annular convex portion 21.

As shown in FIGS. 2A and 2B, each of the fine holes 5 is of a circular cross section, and has such a size or diameter as to allow viscous materials or fibrous materials in the liquid to be filled to pass therethrough, and also has such a length as to suppress liquid dripping due to the surface tension of the liquid. The arrangement of the fine holes 5 is such that they are arranged in concentric circles from the center of the flow straightening plate, with the distances between adjacent fine holes 5 being set to be equal to one another as much as possible.

The fine holes 5 are formed in parallel with respect to a central axis M of the flow straightening plate 3, as shown in (C) and (D) of FIG. 2, and a divergent chamfered portion 7, which act as a guide means for guiding fine streams of liquid flowing out from adjacent individual fine holes in a direction to bring them into contact with one another, is formed on an opening edge of an outlet of each fine hole 5 on an outlet side surface 6 of the flow straightening plate 3.

In addition, the outlet side surface 6 of the flow straightening plate 3 is of a spherical shape in which a central portion thereof protrudes toward a downstream side more than a peripheral portion thereof does, with a tilt or inclination of the outlet side surface gradually increasing in accordance with an increasing distance from the center thereof. On the other hand, the chamfered portion 7 of each fine hole 5 is constructed or formed by moving a tip end 110 of a chamfering tool in a direction of central axis N of each fine hole 5 for chamfering, as shown in FIG. 2(C), and the amount of chamfering becomes larger by an increased amount of inclination the outlet side surface 6 at the center side of the flow straightening plate 3 than the outer peripheral side thereof. An angle θ of each chamfered portion 7 corresponds to an angle of the tip end 110 of the chamfering tool, and is preferably in the range of about 90 degrees to 120 degrees.

In addition, the chamfered portions 7 of mutually adjacent fine holes 5 are constructed in such a manner that they overlap with each other without leaving the outlet side surface 6 of the flow straightening plate 3 between the adjacent fine holes 5. However, the individual chamfered portions 7 may be constructed to be arranged close to one another without being overlapped.

Here, note that the shape of the outlet side surface 6 of the flow straightening plate 3 is not limited to a spherical shape, but may be a stepped shape or a conical shape, for example. In short, the outlet side surface 6 need only to be shaped in such a manner that the central side thereof protrudes more than the peripheral portion does.

On the other hand, an inlet side end face 8 of the flow straightening plate 3 is a flat surface orthogonal to the flow direction of liquid. Accordingly, the lengths of the fine holes 5 are designed to increase toward the central portion. As a result, the flow speed of liquid in the radius direction can be made uniform, thus making it possible to obtain a flow straightening effect in a wide range of the flow rate.

According to the filling nozzle of this embodiment, it is constructed such that the flow of liquid is regulated by means of the flow straightening plate 3 having the fine holes 5 of the predetermined lengths. With such a construction, clogging of the fine holes 5 due to fibrous materials, etc., can be prevented by selecting the size of the fine holes 5. Moreover, when the filling of liquid is stopped, the liquid can be held in the fine holes 5 under the action of the surface tension of the liquid.

Although depending on the kind of the liquid used, if the diameter d of each fine hole 5 is in the range of about 1-3 mm and the lengths L thereof is in the range of about 2-20 mm, fibrous materials and viscous materials in the liquid can be passed through the fine holes, and at the same time, a liquid dripping suppression effect due to the surface tension of the liquid can be obtained when the flow of the liquid is stopped.

In addition, even in case where a negative pressure is to be generated in the nozzle for prevention of liquid dripping, the liquid is held in the fine holes 5 if the length L of each fine hole 5 is in the range of about 2-20 mm, so ambient atmosphere outside the nozzle can be prevented from coming into the nozzle, thus making it possible to prevent gas or air from being entrained in the liquid.

The streams of liquid independently injected from the individual adjacent fine holes 5 are transmitted through the divergent chamfered portions 7 formed at the outlet sides of the fine holes 5, whereby they are forcedly brought into contact with one another on the outlet side surface 6 to converge into a flow of liquid of a thick or large circular cross section, which then flows out in a stable manner without entraining air therein.

In particular, the surface shape of the flow straightening plate 3 is of a spherical shape in which the central portion thereof protrudes toward a downstream side more than the peripheral portion thereof does, so the streams of liquid, being brought into contact with one another on the outlet side surface 6 of the flow straightening plate 3, can be converged in the central portion thereof to form a stable liquid flow of a circular cross section. The thickness of the thus converged flow is squeezed more thinly than the flow passage cross section of the nozzle body 2.

In addition, the lengths of the fine holes 5 are designed to increase toward the central portion, so the flow speed of liquid in the radius direction can be made uniform, thus making it possible to obtain a flow straightening effect in a wide range of the flow rate.

When three kinds of liquids having different viscosities, i.e., water, tomato juice (300 [m·Pa·s]), and corn potage (700 [m·Pa·s]), are caused to flow at a flow rate of 100 ml/second, stable liquid flows were able to be achieved without disturbance for any of these liquids. The flow rate is effective within a wide range of about 10-300 [ml/second].

Although in the above-mentioned embodiment, the fine holes 5 are formed so as to be in parallel with respect to the central axis M of the flow straightening plate 3, it can be constructed such that the central axis N of each fine hole 5 is inclined in a direction from its inlet to its outlet with respect to the central axis M of the flow straightening plate 3 toward the center thereof, as shown in (A) and (B) of FIG. 3. With such a construction, in cooperation with the spherical shape of the outlet side surface 6, the streams of liquid flowing out from the individual fine holes 5 becomes more liable to converge in the center.

In addition, the shape of the inlet side end face 81 can be designed in such a manner that the central portion thereof protrudes to an upstream side more than the peripheral portion thereof does, as shown in (C) of FIG. 3. In the illustrated example, it becomes a conical shape with the central portion taken as a vertex. If doing so, in cooperation with the spherical shape of the flow straightening plate at the outlet side thereof, the difference between the length of a fine hole 5 in the central portion and the length of a fine hole 5 in the peripheral portion can be made larger, thus making it possible to reduce the flow speed of the liquid, passing the central portion to a further extent. Accordingly, it is effective for a wider flow rate range. The shape of this inlet side end face 81 is not limited to the conical shape, but may be a stepped shape, or a spherical shape, similar to the shape at the outlet side.

Of course, such a shape of the end face at the inlet side can be applied to the flow straightening plate 3 having the fine holes 5 arranged in parallel with respect to one another, as shown in FIG. 1 and FIG. 2.

Next, reference will be made to other embodiments of the present invention.

In the following description, only differences from the above-mentioned first embodiment will be mainly explained with the same component parts being identified by the same symbols while omitting an explanation thereof.

Embodiment 2

(A) and (B) of FIG. 4 show a filling nozzle according to a second embodiment of the present invention.

In this second embodiment, circumferential grooves 207 connecting outlets of individual fine holes 4 to one another are formed, as guide means, on a spherical outlet side surface 6 of a flow straightening plate 3. The individual fine holes 4 are arranged on concentric circles, and predetermined spaces are formed between adjacent ones of the circumferential grooves 207.

Embodiment 3

(C) and (D) of FIG. 4 show a filling nozzle according to a third embodiment of the present invention.

In this third embodiment, radial grooves 307 connecting outlets of individual fine holes 4 to one another in a radial manner are formed, as guide means, on a spherical outlet side surface 6 of a flow straightening plate 3.

The radial grooves 307 include radius grooves 371 that are arranged so as to pass through the center of the flow straightening plate 3, and V-shaped grooves 372 that are arranged between the radius grooves 371 and in parallel to the radial grooves 371.

Here, note that the guide means are not limited to those in the above-mentioned respective embodiments, but may instead be constructed, for example, such that either of the chamfered portions 7 of the above-mentioned first embodiment, the circumferential grooves 207 of the second embodiment, and the radial grooves 307 of the third embodiment are combined with one another in an appropriate manner. Or, the guide means may comprise grooves that connect the outlets of the respective fine holes to one another in a helical or spiral manner. In short, the guide means need only to be constructed so as to guide the fine streams of liquid flowing out from the adjacent fine holes in a direction to bring them into contact with one another.

The invention claimed is:

1. A filling nozzle in which a flow straightening member for straightening a flow of liquid injected through the interior of a nozzle body is arranged in the hollow nozzle body, wherein said flow straightening member comprises a flow straightening plate with a plurality of fine holes formed therethrough so as to pass the liquid, and a guide means is formed on a surface of said flow straightening plate at an outlet side thereof for guiding fine streams of liquid flowing out from adjacent ones of the individual fine holes in a direction to converge the liquid into a smaller stream as the liquid exits the outlet side of the nozzle.

2. The filling nozzle as set forth in claim 1, wherein the shape of the surface of said flow straightening plate at the outlet side thereof is such that a central portion thereof is thicker than a peripheral portion thereof.

3. The filling nozzle as set forth in claim 1, wherein the guide means comprises a divergent chamfered portion formed at an outlet side of each fine hole such that the chamfer surface in each fine hole on a central side thereof is greater than the chamfer surface on a peripheral side thereof.

4. The filling nozzle as set forth in claim 1, wherein the guide means comprises circumferential grooves connecting outlets of the individual fine holes to one another.

5. The filling nozzle as set forth in claim 1, wherein the guide means comprises radial grooves connecting outlets of the individual fine holes to one another.

* * * * *